United States Patent [19]

Brown

[11] Patent Number: 4,770,410

[45] Date of Patent: Sep. 13, 1988

[54] WALKER

[76] Inventor: Guies L. Brown, 12465 NW. 18th Ct., P.O. Box 681103, Miami, Fla. 33167

[21] Appl. No.: 881,600

[22] Filed: Jul. 3, 1986

[51] Int. Cl.[4] ..... A61H 3/00

[52] U.S. Cl. ..... 272/70.3; 297/5; 297/485; 135/67

[58] Field of Search ..... 272/70, 70.3, 70.4, 272/70.2; 280/200, 647, 290, 201, 202, 87.01, 87.02 R, 7.1; 135/65, 67; 297/464, 467, 468, 487, 485, 5, 148, 153; 392/175, 163, 32, 42

[56] References Cited

U.S. PATENT DOCUMENTS

| | | | |
|---|---|---|---|
| 2,792,052 | 5/1957 | Johannesen | 297/5 |
| 3,165,314 | 1/1965 | Clearman | 272/70.3 |
| 3,252,704 | 5/1966 | Wilson | 272/70.3 |
| 3,350,095 | 10/1967 | Clasen | 272/70.3 |
| 3,397,883 | 8/1968 | Kiehn | 272/70.3 |
| 3,778,052 | 12/1973 | Andow | 272/70.4 |
| 4,111,445 | 9/1978 | Hailbeck | 280/79.3 |
| 4,155,416 | 5/1979 | Ausmus | 180/214 |
| 4,165,127 | 8/1979 | Vago | 280/87.02 R X |
| 4,171,132 | 10/1979 | Kassai | 272/70.3 |
| 4,212,493 | 7/1980 | Ledesky | 297/6 |
| 4,342,465 | 8/1982 | Stillings | 272/70.3 X |

FOREIGN PATENT DOCUMENTS

| | | | |
|---|---|---|---|
| 2547721 | 12/1984 | France | 135/67 |
| 1553049 | 9/1979 | United Kingdom | 272/70 |

*Primary Examiner*—Richard J. Apley
*Assistant Examiner*—Howard Flaxman
*Attorney, Agent, or Firm*—Fleit, Jacobson, Cohn & Price

[57] ABSTRACT

An invalid walker has a frame in the form of a seat and seat back with arms and telescopic legs depending from the arms. An air compressor is provided on the seat back for extending and retracting the legs under occupant control so as to raise and lower the walker as between occupant-seated and occupant-standing positions. A removable front section is provided for the walker to enclose the occupant and form a safety constraint. A reinforcing ring with auxiliary stabilizing wheels is provided around the bottom of the legs. An occupant may use the device in a seated or standing position to assist in walking with the occupant's feet in ground engagement.

13 Claims, 3 Drawing Sheets

24
80
14
26
16
4
50
56
42
15
5
10
40
48
44
46
12
12a
18
18
63
61
66
6
65
6
22
22
62
62
4

WALKER

BACKGROUND AND SUMMARY OF THE INVENTION

This invention relates to a therapeutic apparatus for assisting an invalid or other occupant in walking. The apparatus comprises generally a framework including a seat and seat back, arms extending from the seat back, and four telescopic wheeled legs. The framework carries an air compressor for supplying compressed air to the legs for extending and retracting same in order to raise and lower the seat portion of the device. The apparatus further includes a removable front section in the form of a first yoke member which releasably attaches between the forward ends of the arms and a second yoke member depending from the first yoke member which releasably attaches to the front of the seat portion. The front section, when attached, forms a safety device for constraining the occupant in the seat. A body harness may also be provided.

Preferably, the apparatus further includes a reinforcing ring around the bottom of the legs with auxiliary stabilizing wheels between the legs and a removable front section providing occupant access to the seat. Controls for the air compressor may be provided on one of the framework arms enabling the occupant to raise and lower the seat as between occupant-standing and occupant-seated positions in both of which the occupant's feet may be in ground contact.

In use, the device is under occupant control for raising and lowering between seating and walking elevations. For walking purposes, the device is occupant propelled while constraining the occupant therein in a secure and safe manner. The peripheral ring-like support at the base of the legs with its auxiliary wheels provides added stability in preventing the device from tipping over during walking. Occupant controlled brakes may be provided at least on the forward wheels. For increased stability, a fifth telescopic hydraulic leg may depend centrally from the backrest portion of the walker.

The walker fulfills an important need in self-rehabilitation of injured patients providing a means whereby the semi-disabled patient may rehabilitate him or herself by encouraging the patient to walk under his or her own power in relative safety and security. The device may, however, also be used in a manner equivalent to a conventional wheelchair.

Applicant is aware of the following U.S. patents relating to invalid walkers and similar therapeutic devices:

U.S. Pat. No. 2,792,052—H. A. I. Johannesen—May 14, 1957

U.S. Pat. No. 3,165,314—J. P. Clearman et al—Jan. 12, 1965

U.S. Pat. No. 3,252,704—C. L. Wilson—May 24, 1966

U.S. Pat. No. 3,397,883—M. Kiehn—Aug. 20, 1968

U.S. Pat. No. 3,778,052—P. Andow et al—Dec. 11, 1973

U.S. Pat. No. 4,111,445—K. Haibeck—Sept. 5, 1978

U.S. Pat. No. 4,155,416—D. L. Ausmus—May 22, 1979

U.S. Pat. No. 4,212,493—E. A. Ledesky—July 15, 1980

None of the above patents, however, discloses a device having the features and advantages of the present invention. In particular, the above patents lack the structure of the present invention and the telescopic facility enabling the occupant under his or her own control to move the device in elevation as between a seated and standing position and to self-propel the device in either position while the occupant is constrained therein in a secure and stable manner.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
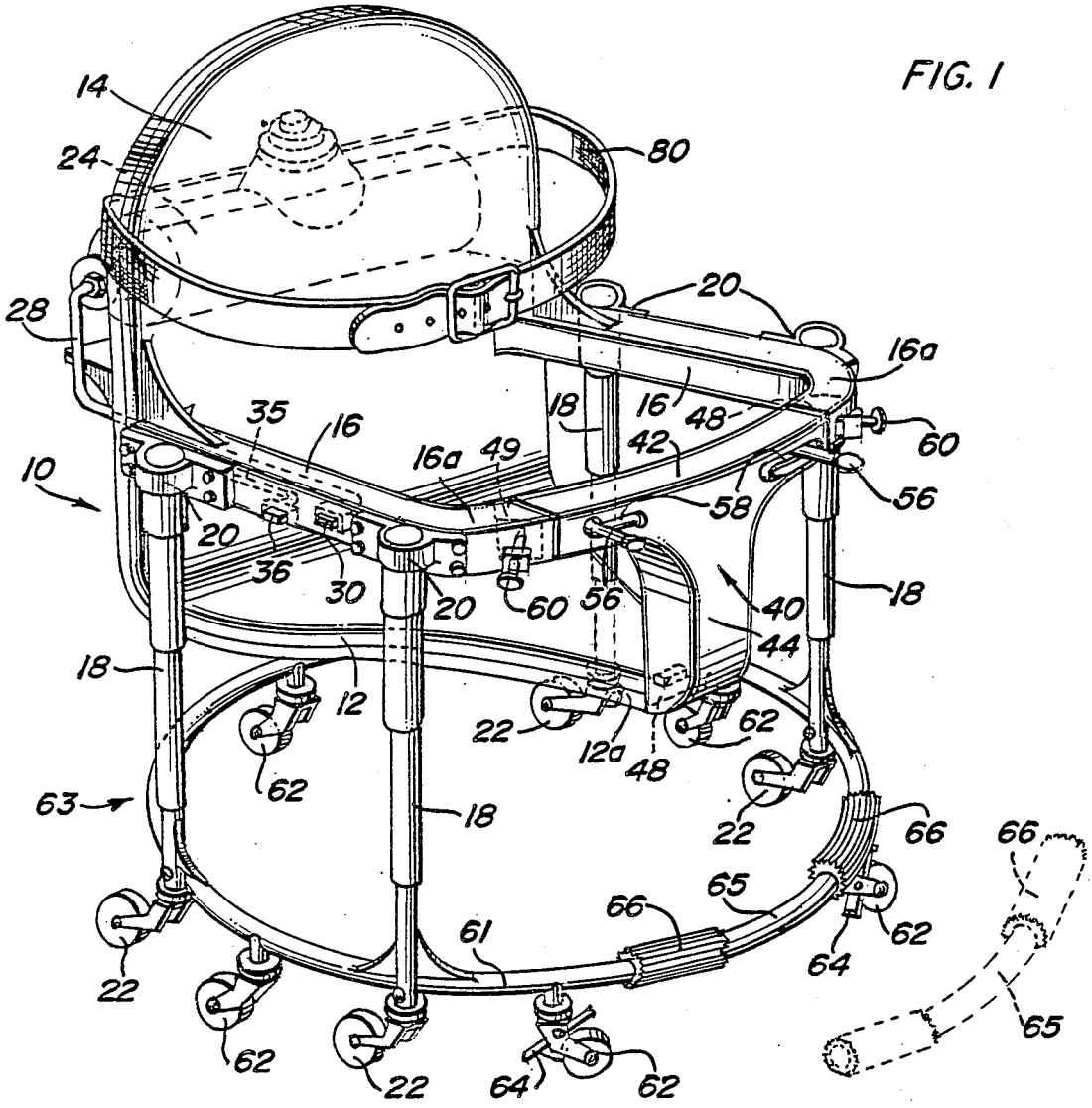
FIG. 1 is a perspective view from the front of an invalid walker in accordance with the invention.
Figure 7:
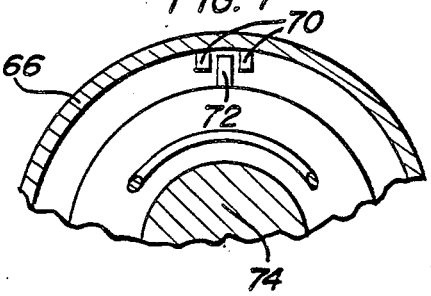
FIG. 7 is a further enlarged sectional view on line 7—7 of FIG. 6.
Figure 6:
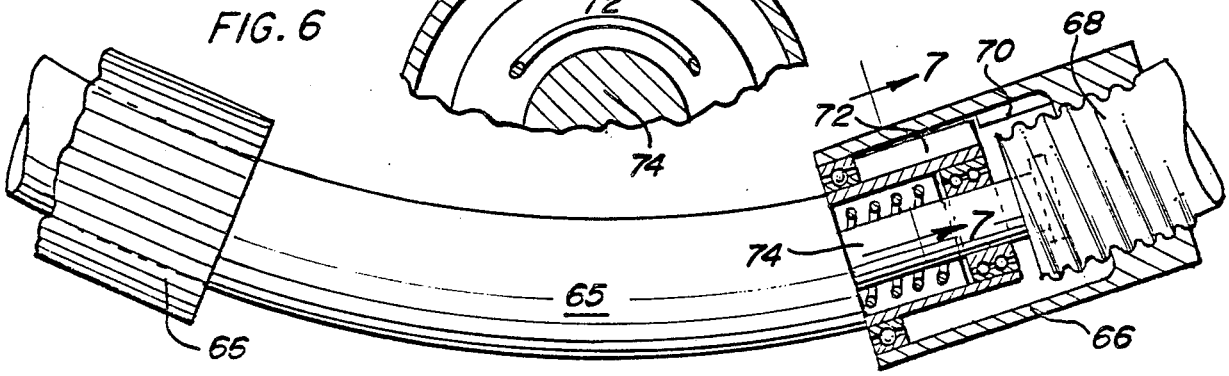
FIG. 6 is an enlarged sectional view on line 6—6 of FIG. 3.
Figure 2:
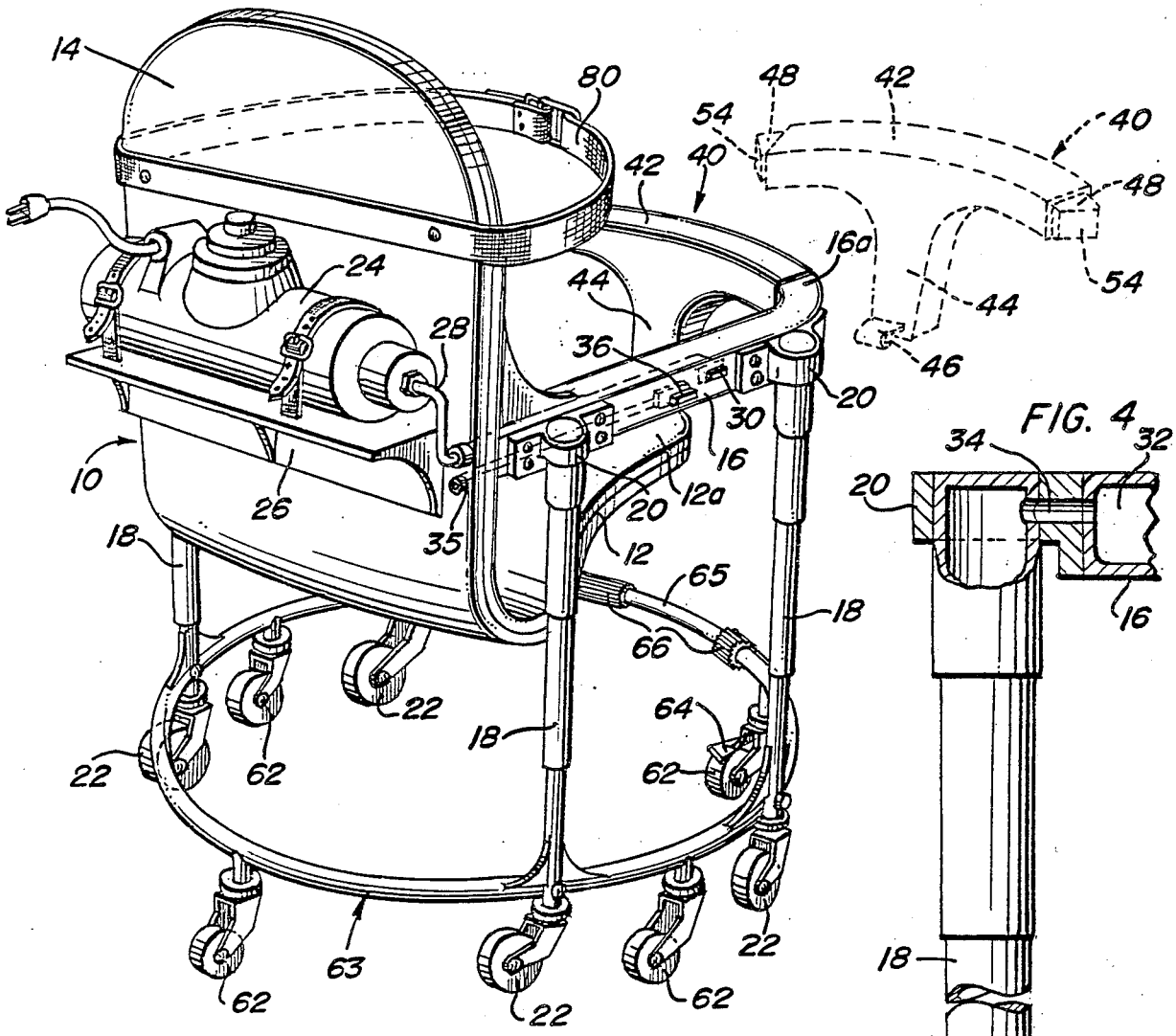
FIG. 2 is a perspective view of the walker from behind.

An invalid walker in accordance with the invention has a framework generally indicated by reference 10, the framework including a seat portion 12, a seat back portion 14 and respective left and right arms 16 extending from the seat back portion. The frame may be made of lightweight aluminum or the like and the seat and seat back portions may be suitably upholstered in known manner. It will be evident that the forward end **12*a* of the seat portion is shaped in a manner similar to a saddle so as to extend between an occupant's legs. Telescopic leg assemblies 18 extend from the rear and forward ends of the respective arms 16 at the four corners of the device, the leg assemblies, for example, being secured to the arms by brackets 20. The lower sections of each leg assembly are provided with rotary wheels or casters 22** of known form.

Figure 4:
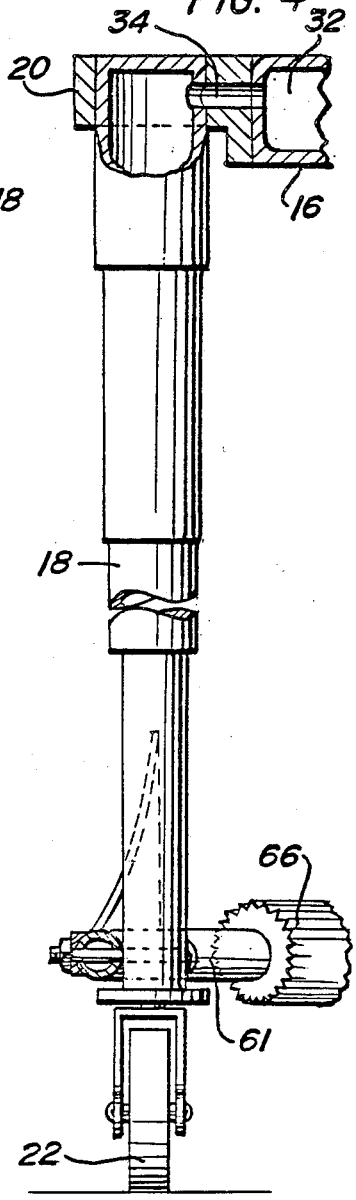
FIG. 4 is a further enlarged sectional view on line 4—4 of FIG. 3.

Telescopic extending and retracting movements of the respective leg assemblies 18 are effected by means of an air compressor 24 carried on a suitable bracket 26 on the seat back portion 12 of the device. It is understood that the compressor is of a well known type which may be operated by mains electricity. An outlet pipe 28 of the compressor leads through an inlet control valve 30 on one arm of the frame to a manifold 32 (part of which is shown in FIG. 4), the manifold extending along the respective arms 16 and through the seat back portion 12 of the frame. The manifold has ports such as port 34 communicating with the respective leg assemblies 18. Also, the manifold has an outlet pipe 35 controlled by another operator actuated valve 36 on the frame arm. It will be appreciated that opening of the valve 30 when the compressor is operating is effective to supply compressed air to the respective leg assemblies for extending the assemblies and thereby elevating the height of the walker. When valve 30 is released and closed, the compressed air is effectively trapped in the leg assemblies so that these are held in the extended positions. To lower the walker, outlet valve 36 is opened thereby exhausting the compressed air and allowing the leg assemblies to retract under the weight of the occupant so as to lower the elevation of the seat.

The walker further includes a removable front section 40 for releasable attachment between the forward ends of arms 16 and the forward end 12*a* of seat portion 12. It will be noted that the forward ends 16*a* of the respective arms are turned inwardly and are provided with pockets 16*b* for receipt of latch devices on the front section, as will be described. The front section 40 has an upper yoke 42 for releasable attachment between the respective arms 16 and a lower yoke 44 depending from the central portion of the upper yoke and having a bent tongue 46 for receipt in a tongue pocket 48 formed in the forward end 12*a* of seat portion 12.

Figure 5:
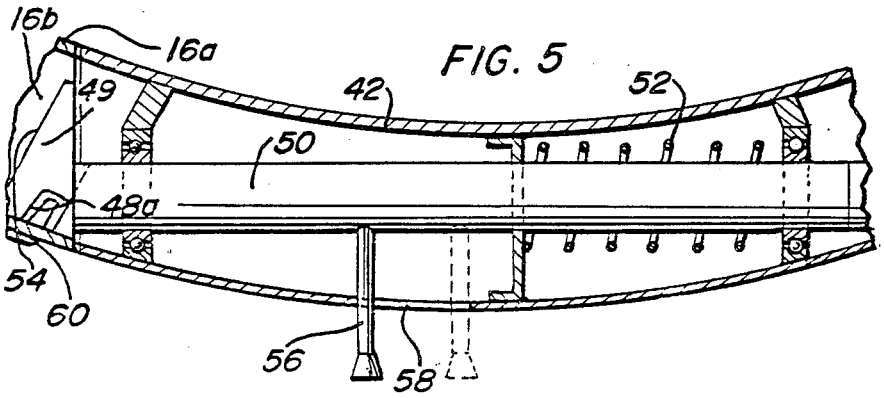
FIG. 5 is a further enlarged sectional view on line 5—5 of FIG. 3.
Figure 3:
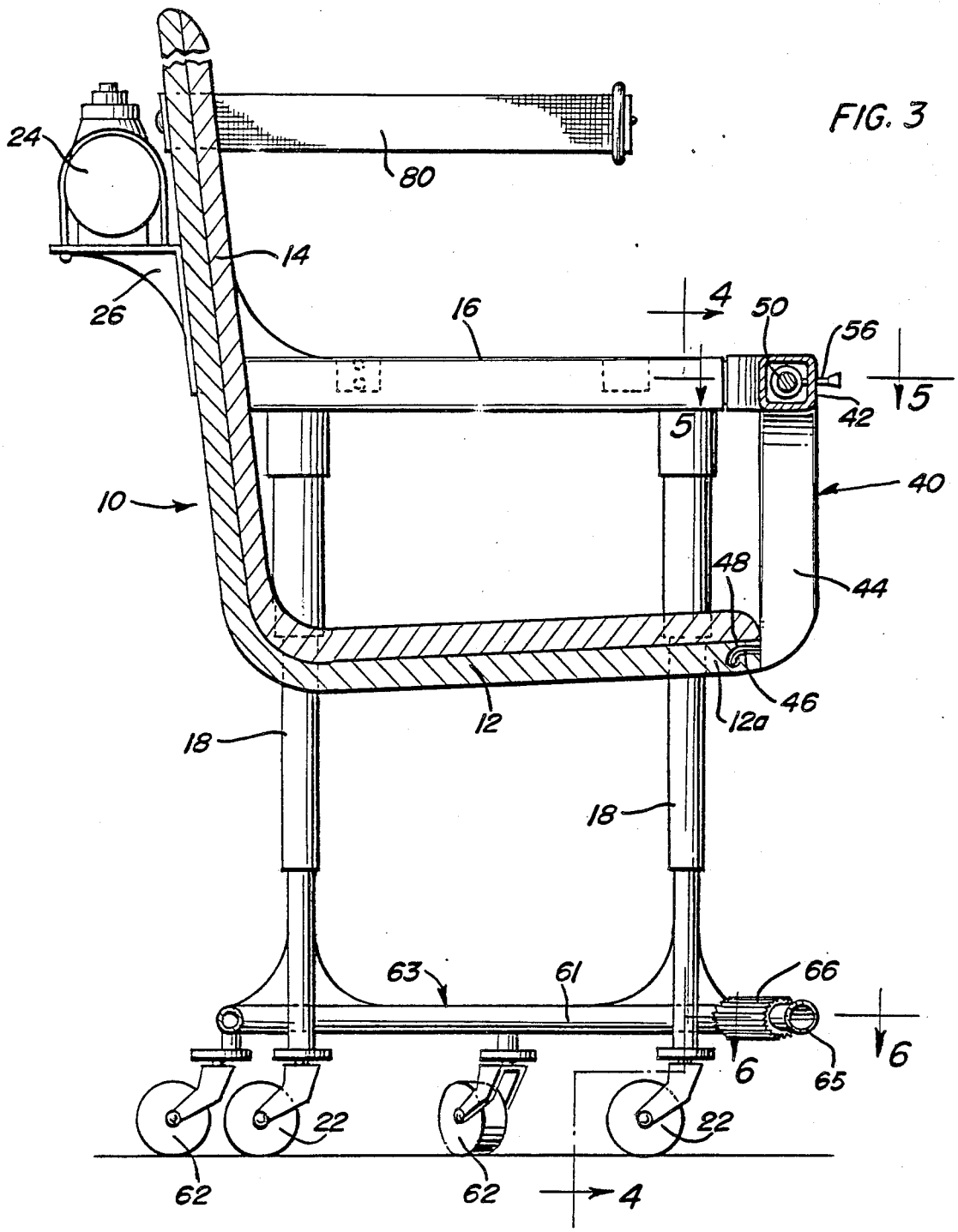
FIG. 3 is an enlarged sectional elevational view of the walker.

The upper yoke portion of 42 of section 40 has releasable latch devices at its opposite ends for receipt respectively in the pockets 16*b* at the ends of the arms. Each latch device, as shown in greater detail in FIG. 5, includes a latch member 49 on a shaft 50 which is biased outwardly of yoke portion 42 by means of a coil spring 52. Further, the latch member 49 has an inclined front camming face 54. Shaft 50 has an operating pin 56 extending through a corresponding slot 58 in yoke portion 42. It will be evident that front section 40 can readily be attached to the frame simply by pushing and snapping the latch members 49 into their respective retaining pockets 16*b* and inserting the tongue 46 into its retaining pocket 48. In so doing, the camming faces 54 of the respective latch devices will provide retraction of the respective latches and snapping engagement into the pockets 16*b*. To remove the front section, the occupant of the walker may simply retract the latches 49 by movement of the pins 56 along the slots 58. Also, it will be evident that the shape of the slots with their curved ends allows the pins 56 to retain the latches in a released position for removal of the front section.

The walker may be provided with safety locks for the front section in the form of releasable spring loaded plungers 60 associated with the forward ends of the respective arms 16*a*, the plungers being adapted to fit into respective openings 48*a* (FIG. 5) in latches 40 to lock these in place. Retraction of the plungers 60 allows front section 40 to be removed in the manner described above.

Secured around the base of the device to the respective lowermost sections of the telescopic leg assemblies 18 is a tubular reinforcing ring 63 which may be secured by any suitable means such as bolts and nuts and/or support brackets to the respective leg assemblies. Further, the supporting ring has auxiliary stablizing rotary wheels or casters 62 between the wheels 22 and at least the forwardmost wheels 62 may be provided with occupant-actuated wheel locks or brake mechanisms 64. Ring 63 may have a removable front section 65 facilitating occupant access to the device. The purpose of reinforcing ring 63 is to generally stabilize and reinforce the device, preventing spreading of the leg assemblies under the occupant's weight and providing added stabilization through the provision of the auxiliary wheels.

Attachment and detachment of the removable section 65 of ring 63 may be by means of axially slidable threaded collars 66 which may thread onto complimentary threads 68 at the respective ends of the fixed ring portion 61. Simple sliding axial collars 66 may be used or alternatively these may be spring biased and have guides 70 for keys 72 on the exterior of section 65. Section 65 may have reduced end portions 74 adapted to fit in the respective ends 68 of the fixed ring section 61 for additional support.

The walker may be optionally provided with an additional restraining strap 80 secured to the seat back portion 14.

It will be understood from the foregoing that the device provides a unique form of therapeutic walker for invalids, which enables the occupant him or herself to control the elevation of the device through the operation of valves 30 and 36 and allows the occupant him or herself to remove the restraining safety section 40 as required. The occupant is securely and firmly retained in the device in a stabilized manner and can perform a self-propelled walking function either from a seated or standing position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An invalid walder comprising frame means for seating an occupant with the occupant's feet in ground contact, the frame means defining a seat portion, a seat back portion and arms extending from the seat back portion on opposite sides of the seat portion, at least four telescopic legs with ground engaging wheels at their lower ends depending from the frame means substantially at four corners thereof, at least a forward pair of the legs depending from forward end portions of the arms, power means for telescopically extending and retracting the legs so as to selectively move the seat portion vertically between occupant-seated and occupant-standing elevations, the seat portion having a forward end configured to extend between the occupant's legs, and the walker further including a removable front section for the frame means with releasable and separable connectors between the front section, the forward end portions of the arms, and the forward end of the seat portion, the front section providing a safety device when connected to the frame means for occupant constraint while providing access to the seat portion when removed from the frame means, said front section comprising a rigid first yoke member having opposite ends with first connectors for releasable attachment to the respective arms to form an enclosed extension of the arms around the front of the walker, and a rigid second yoke member depending from the central portion of the first yoke member and having a second connector for releasable attachment to the forward end of the seat portion.

2. The invention of claim 1 including an at least partcircular reinforcing bar connecting the respective legs adjacent the wheels.

3. The invention of claim 2 wherein the reinforcing bar carries auxiliary ground-engaging wheels between the legs.

4. The invention of claim 2 wherein the reinforcing bar is in the form of a full circle and includes a removable section between the forward pair of legs for facilitating access to the frame means when it is removed.

5. The invention of claim 1 wherein the power means comprises compressor means for supplying compressed air to the respective legs to extend same through manifold means in the frame means, and occupant-operated means on one of the arms for controlling flow of compressed air to and from the legs to extend and retract same.

6. The invention of claim 5 wherein the compressor means is mounted on the seat back portion and the walker includes an inlet conduit extending from the compressor to the manifold means and an outlet conduit from the manifold means wherein the occupant-operated means includes a first control valve for controlling airflow through the inlet conduit and a second control valve for controlling airflow through the exhaust conduit.

7. The invention of claim 1 wherein the first connectors comprise spring loaded latches extending from the opposite ends of the first yoke member for receipt in respective pockets at the ends of the arms, each latch having a shank portion extending into the first yoke member and a pin projecting from the shank portion for receipt in a slot in the first yoke member, the pin being movable along the slot for withdrawing the latch from its respective pocket in order to remove the front section from the frame means.

8. The invention of claim 7 wherein each latch has an inclined camming surface adapted to cooperate with an end surface of the respective arm for depressing the latch into the first yoke member when attaching the front section to the frame means and then releasing the latch to spring into the respective pocket.

9. The invention of claim 7 wherein each arm has a releasable spring loaded plunger lock extending into the respective pocket for engaging in an opening in the respective latch and releasably locking the front section to the frame means.

10. The invention of claim 1 wherein the second connector comprises a tongue extending from the second yoke member for receipt in a pocket in the forward end of the seat portion.

11. The invention of claim 4 wherein the removable section of the reinforcing bar has axially slidable internally threaded sleeves at opposite ends thereof for engagement with complementary threads on opposite ends of a fixed section of the reinforcing bar.

12. The invention of claim 11 wherein the removable section of the reinforcing bar has reduced-section end portions for receipt in the respective opposite ends of the fixed section.

13. An invalid walker comprising frame means for receiving an occupant with the occupant's feet in ground contact, seat means supported from the frame means and including a seat portion and a seat back portion, said frame means including arms extending from the seat back portion on opposite sides of and above the seat portion, a plurality of telescopic legs with ground engaging wheels at their lower ends depending from the arms, power means for telescopically extending the legs, means enabling retraction of the legs so as to selectively move the seat portion vertically between occupant-seated and occupant-standing positions, the seat portion having a forward end configured to extend between the occupant's legs, said frame means including a rigid removable front section extending between the forward ends of the arms and including a rigid depending portion extending toward the forward end of the seat portion and releasable connectors between the front section, the forward end portions of the arms, and the forward end of the seat portion to enable complete removal of the front section, the front section providing a safety device for occupant constraint while providing access to the seat portion when removed, said power means including control means on one of the arms in accessible position to an occupant, said means enabling retraction including control means on one of the arms inaccessible position to an occupant, said arms, front section and seat portion being rigidly interconnected by the connectors to provide a stable rigid structure.

* * * * *